US008475539B2

(12) United States Patent
Frelechoux

(10) Patent No.: US 8,475,539 B2
(45) Date of Patent: Jul. 2, 2013

(54) ADDITIVE COMPOSITION FOR TEXTILE AUXILIARIES

(75) Inventor: Richard Frelechoux, Mathieu (FR)

(73) Assignee: Total Raffinage Marketing, Puteaux (FR)

( * ) Notice: Subject to any disclaimer, the term of this patent is extended or adjusted under 35 U.S.C. 154(b) by 0 days.

(21) Appl. No.: 12/992,214

(22) PCT Filed: May 12, 2009

(86) PCT No.: PCT/IB2009/005570

§ 371 (c)(1),
(2), (4) Date: Nov. 11, 2010

(87) PCT Pub. No.: WO2009/138851

PCT Pub. Date: Nov. 19, 2009

(65) Prior Publication Data

US 2011/0061181 A1 Mar. 17, 2011

(30) Foreign Application Priority Data

May 13, 2008 (FR) ..... 08 02572

(51) Int. Cl.

| | |
|---|---|
| ***D06M 23/00*** | (2006.01) |
| ***D06M 15/70*** | (2006.01) |
| ***B05D 3/12*** | (2006.01) |
| ***B05D 1/28*** | (2006.01) |

(52) U.S. Cl.
USPC ..... 8/115.6; 8/115.51; 8/585; 8/604; 8/609; 8/611; 8/908; 8/912; 8/930; 427/428.01; 252/8.81

(58) Field of Classification Search
USPC ..... 8/115.6, 137, 115.51, 585, 604, 609, 8/611, 908, 930, 912; 252/8.91, 8.81; 510/276, 510/328, 337, 342; 427/428.01
See application file for complete search history.

(56) References Cited

U.S. PATENT DOCUMENTS

| | | | | |
|---|---|---|---|---|
| 3,794,605 | A * | 2/1974 | Diehl | 510/361 |
| 3,841,831 | A * | 10/1974 | Miller | 8/532 |
| 3,907,746 | A | 9/1975 | Follows | |
| 4,174,305 | A * | 11/1979 | Burns et al. | 510/299 |
| 5,460,632 | A | 10/1995 | Ruggiero et al. | |
| 6,258,928 | B1 | 7/2001 | Baird et al. | |
| 7,141,104 | B2 * | 11/2006 | De Voeght et al. | 106/31.49 |
| 2004/0011248 | A1 * | 1/2004 | Taguchi et al. | 106/31.28 |
| 2005/0197419 | A1 * | 9/2005 | Graziano et al. | 522/74 |
| 2006/0205628 | A1 * | 9/2006 | Deinhammer et al. | 510/386 |
| 2009/0118155 | A1 * | 5/2009 | Batchelor et al. | 510/343 |

FOREIGN PATENT DOCUMENTS

DE 10 2004 042 738 3/2006

* cited by examiner

*Primary Examiner* — Lorna M Douyon
*Assistant Examiner* — Amina Khan
(74) *Attorney, Agent, or Firm* — Harness, Dickey & Pierce, P.L.C.

(57) ABSTRACT

The present disclosure relates to compositions for preparing textile auxiliaries, which are used in particular to enhance the dyeing affinity of textile fibers. The disclosure concerns a composition in the form of an aqueous emulsion or solution which comprises (a) one or more hydroxyalkylamines of formula: $NX_1X_2(C_nH_{2n}OH)$, where $X_1$ and $X_2$ are, independently of one other, either hydrogen or hydroxyalkyl radicals of respective formulae $C_{n1}H_{2n1}OH$ and $C_{n2}H_{2n2}OH$, and n, $n_1$ and $n_2$ are integers from 2 to 6, and (b) one or more anionic surfactants selected from alkyl sulphates, alkylsulphonates such as paraffinsulphonates, alkylarylsulphonates, alkyl ether phosphates, and alkyl carboxylates, and at least one compound (c) and/or (d), where (c) is selected from one or more thioureas (thiocarbamides) of formula $R_1R_2N(CS)NR_3R_4$, where $R_1$, $R_2$, $R_3$ and $R_4$ are independently either hydrogen or hydrocarbon radicals having 1 to 5 carbon atoms, and (d) is selected from one or more dialkyl sulphosuccinates in combination with one or more anti-freeze agents selected from methanol, isopropanol, glycols, preferably glycerol, ethylene glycol, propylene glycol or glycol ethers, preferably ethers of ethylene glycol or of propylene glycol.

18 Claims, No Drawings

ADDITIVE COMPOSITION FOR TEXTILE AUXILIARIES

CROSS-REFERENCE TO RELATED APPLICATIONS

This application is a National Phase Entry of International Application No. PCT/IB2009/005570, filed on May 12, 2009, which claims priority to French Application 0802572, filed on May 13, 2008, both of which are incorporated by reference herein.

TECHNICAL FIELD

The present invention relates to additive compositions for the preparation of textile auxiliaries used in particular to enhance the dye affinity of textile fibres.

BACKGROUND

It is frequently necessary to apply heat-setting treatments to cloth formed of textile fibres to impart dimensional stability that is compatible with the use thereof. This is particularly true for synthetic fibres optionally associated with elastane fibres in knits. Knitted polyamide fibres are therefore treated at temperatures lying between 170 and 200° C. and even above, notably depending upon the elastane content of the knits. An increase in elastane content leads to increasing the heat-set temperature to obtain the required dimensional stability.

Yet this heat setting also has the effect of deteriorating the mechanical properties of yarns, notably if these are polyamide fibres. This mechanical deterioration in itself is detrimental, but factory observations on downgraded batches or laboratory observations systematically correlate this deterioration in mechanical properties with reduced dye affinity of the fibres, and with a problem of level dyeing. It is therefore difficult during subsequent dyeing operations to obtain knits having uniform colour and the desired colour intensity. An increase in the heat-treatment temperature generally leads to increased deterioration of mechanical properties and dye affinity, but the results vary greatly from one batch of fibres to another.

It is also frequently ascertained, in one same faulty batch, that there are different types of dyeing defects (bands, light, very light areas; not fully dyed . . . ). The phenomenon is not only random but can only be ascertained a posteriori, after the dyeing operation. Knits that are not uniformly dyed or too pale in colour have to be corrected with a darker colour or dyed a second time, and are often downgraded which is a causes of major economic loss.

It is frequent in the textile industry to use levelling agents which allow better dispersion of the colouring agent in the dye bath, or which act either through their affinity with the fibre or through their affinity with the dye. These may be non-ionic surfactants for example such as ethoxylated fatty alcohols, ethoxylated or non-ethoxylated fatty acids, ethoxylated fatty amines, alkylphenols and fatty mercaptans, or products containing bisulphate anions and quaternary ammonium compounds. Aside from the fact that some of these compounds prove to be difficult to eliminate, are scarcely biodegradable, even toxic, they do not systematically offset the loss of dye affinity and uneven colouring of polyamide fibres after heat treatment. A few, specific commercial products intended to overcome the loss of dye affinity observed after heat treatment are formulated for example with n methylpyrrolidone, hydroxylamine, polyglycol ether, butyl diglycol. However their efficacy is not systematic and is highly variable from one batch of fibres to another.

There is therefore a need to provide additives for textile auxiliaries that, after heat treatment for dimensional stability, can impart more satisfactory dye affinity and improved dye levelling. There is also a need to obtain this result more systematically, irrespective of the quality of the starting fibre and over the entire heat-treatment temperature range in particular the higher temperatures used in practice which are higher than 180° C. being in the order of 190° C., 195° C., 200° C. and above.

SUMMARY

Unexpectedly, the applicant has evidenced that some specific components ensuring conventional functions, notably wetting or anti-freeze agents, when combined together showed remarkable synergy to preserve mechanical properties, dye affinity and level dyeing of fibres e.g. polyamide fibres subjected to dimensional stabilisation heat treatment, at temperatures varying between 170 and 210° C., preferably between 170 and 200° C.

The present invention therefore concerns a composition in the form of an aqueous solution or emulsion comprising:

(a) one or more hydroxyalkylamines of formula: $NX_1X_2(C_nH_{2n}OH)$ in which $X_1$ and $X_2$ each independently are either hydrogen or hydroxyalkyl radicals of respective formulas $C_{n1}H_{2n1}OH$ and $C_{n2}H_{2n2}OH$ and n, $n_1$, $n_2$ are integers ranging from 2 to 6, and (b) one or more anionic surfactants chosen from among alkyl sulphates, alkyl sulphonates (paraffin sulphonates), alkylaryl sulphonates, alkylether phosphates, alkyl carboxylates, and at least one compound (c) and/or (d) such that:

(c) is chosen from among one or more thioureas (thiocarbamides) having the formula $R_1R_2N(CS)NR_3R_4$ where $R_1$, $R_2$, $R_3$, $R_4$ are each independently either hydrogen or hydrocarbon radicals having 1 to 5 carbon atoms, (d) is chosen from among one or more dialkyl sulphosuccinates in combination with one more anti-freeze agents chosen from amongst methanol, isopropanol, glycols preferably glycerol, ethylene glycol, propylene glycol, or glycol ethers preferably ethers of ethylene glycol or propylene glycol.

Said compositions systematically preserve good mechanical fibre properties and very good dye affinity, greater than those obtained with prior art textile auxiliaries, irrespective of the origin of the fibres e.g. polyamides and at high treatment temperatures. Without being bound by any theory, it would appear that the phenomenon of deteriorated mechanical properties, loss of dye affinity and lack of level colouring observed in fibres e.g. polyamide fibres subjected to heat treatment are related to a phenomenon of surface oxidation of the fibres. Preservation of dye affinity is constant, and the uncertainties ascertained in prior art processes are eliminated. Not only is better preservation of dye affinity ascertained, but also improved level dyeing.

On account of their form as aqueous solution or emulsion, these additives for textile auxiliaries according to the invention provide hazard-free handling for operators. It is also possible to formulate additives according to the invention having minimum toxicity, which have best possible neutrality for the environment and hence can preferably be easily eliminated and are biodegradable. Also, these additives have good wettability with respect to polyamide fibres. On account of their composition and notably through the presence of hydroxyalkyl amines or sequestering agents, these products can easily be stored at temperatures around 0° C. or below without any risk of precipitation of the active ingredients.

Preferably, in the compositions of the invention (a) represents 1 to 15 weight %, preferably 2 to 10 weight %, or further preferably 6 to 9 weight %, (b) represents 10 to 50 weight %, preferably 15 to 40 weight % or further preferably 25 to 35 weight %, (c) and/or (d) represent 3 to 15 weight %, and the quantity of water represents less than 75 weight % of the composition, preferably 10 to 70 weight %, further preferably 50 to 60 weight %. Preferably, in the compositions of the invention, the sequestering agent(s) represent 0.2 to 2 weight % of the composition. Preferably, in the composition of the invention at least one hydroxyalkylamine (a) is such that $X_1$ and $X_2$ represent hydrogen, and n is an integer ranging from 2 to 6. The hydroxyalkyamine (a) is chosen from among monoethanolamine, diethanolamine or triethanolamine.

Preferably, in the compositions of the invention, the alkyl groups of the anionic surfactants (b) comprise 8 to 22 carbon atoms, preferably 10 to 18 carbon atoms. Preferably, in the composition of the invention, among the thioureas (c) at least one radical $R_1$, $R_2$, $R_3$ or $R_4$ represents hydrogen, preferably $R_1$, $R_2$, $R_3$ and $R_4$ represent hydrogen. Preferably in the compositions of the invention, the alkyl dialkylsulphosuccinate groups of compounds (d) comprise 8 to 22 preferably 8 to 12 carbon atoms. Preferably, in the composition of the invention the (d) compounds are chosen from among the salts of alkali metals and alkaline-earth metals, preferably sodium, preferably sodium dioctyl sulphosuccinate. Preferably, in the compositions of the invention the glycol ethers of composition (d) meet the formula: $R—O—(CH_2—CH(X))_{n3}$-0-R' where X is either a hydrogen atom or a $CH_2$ group, R, R' being carbon chains comprising between 1 and 5 carbon atoms, and $n_3$ is an integer between 1 and 10, preferably 1 and 5 and is preferably 1.

According to one preferred embodiment, the composition of the invention comprises the compounds (a), (b), (c) and a sequestering agent such as described above, or else comprises the compounds (a), (b) and (d) such as described above. The present invention also concerns textile auxiliaries incorporating the composition according to the invention, obtained by diluting these compositions in water. Preferably, in the textile auxiliaries, the total quantity of water represents more than 75 weight %, preferably 95 to 99 weight %. Further preferably, in the textile auxiliaries the total quantity by weight of active matter represented by the compounds (a), (b), (c) and/or (d) ranges from 0.2% to 25%, preferably from 1% to 5%.

A further subject of the present invention is a process for the treatment of textile yarns, fabrics or knits intended to undergo heat treatment optionally followed by dyeing which, upstream of the heat treatment, comprises pre-treatment of said yarns, fabrics or knits by immersion in a pad-bath containing a textile auxiliary according to the invention. During the pre-treatment, said fabrics or knits are pad mangled so that they are coated with 0.1 to 5 weight %, preferably 1 to 4%, further preferably 2 to 4 weight % of active matter (a)+(b) and/or (d) relative to the dry weight of the yarn, fabric or knit. Between their production and their shaping into ultimate form in dyed, ready-to-use knits or fabrics, the fibres effectively undergo a multitude of various treatment and conditioning operations during spinning, spooling, knitting, weaving, dimensional stabilisation treatment, dyeing, . . . . The fibres may therefore come into contact with a large quantity of additives e.g. wetting agents, detergents, lubricants, antistatic agents, biocides, bactericides, sequestering agents, hydrogen peroxide stabilisers, sizing agents, dispersants, pH stabilisers, anti-foaming agents, levelling agents, dyes, dye accelerators, . . . .

The introduction of a new treatment step with the compositions of the invention, having proven compatibility with the usual additives used in the chain of textile treatments, and contained within this chain of successive treatments, allows the least possible perturbation of upstream and downstream processes. The compositions of the invention can be added to the treatment line of textile knits and fabrics prior to the heat-setting for dimensional stabilisation which itself precedes the dyeing operation, without changing process conditions. Since the compositions of the invention are in aqueous solution or aqueous emulsion form, they are directly diluted in the pad-bath upstream of the heat-setting machine.

The present invention also relates to the use of these textile auxiliaries to preserve the tenacity and tensile strength of the textile fibres and yarns formed of textile fibres intended to undergo heat treatment. A further subject of the present invention is the use of these textile auxiliaries to preserve the dye affinity of textile fibres, and yarns, fabrics or knits of textile fibres intended to undergo heat treatment. It also concerns the use of the same textile auxiliaries as dye levelling agents for textile fibres and yarns, knits or fabrics consisting of textile fibres.

DETAILED DESCRIPTION

Hydroxyalkylamine (a)

The hydroxyalkylamines of the compositions according to the invention meet the formula $NX_1X_2(C_nH_{2n}OH)$ where $X_1$ and $X_2$ each independently are either hydrogen or hydroxyalkyl radicals of respective formulas $C_{n1}H_{2n1}OH$ and $C_{n2}H_{2n2}OH$ and n, $n_1$, $n_2$ are integers ranging from 2 to 6. These compounds impart cold stability properties to the additive compositions of the invention. They can therefore be cold stored (around 0° C.) without precipitation of, the various compounds in aqueous solution. The hydroxyalkylamines also reinforce the antioxidant properties of the additive compositions and textile auxiliaries according to the invention, translating as an increased capability for dye affinity preservation and increased mechanical properties of the textile fibres.

It must be possible for these compounds to be placed in aqueous solution, and this is why compounds are preferred in which the alkyl radicals contain no more than 5 carbon atoms i.e. where n and optionally $n_1$ and/or $n_2$ contain between 2 and 5 carbon atoms, preferably between 2 and 3. Monoethanolamine (MEA), diethanolamine, triethanolamine are preferred. The additive compositions according to the invention preferably contain 1 to 15 weight % of one or more hydroxyalkylamines, or 2 to 15%, or 3 to 10 weight %, preferably between 5 and 10 weight % and further preferably between 6 and 9 weight % of one or more hydroxyalkylamines.

Anionic Surfactants (b)

These compounds are wetting agents notably used in various textile treatment operations (washing, mercerization, bleaching) and allow:

- perfect "wetting" of the textile material,
- emulsifying of lipophilic impurities
- dispersion of insoluble substances and various degradation products.

Like the hydroxyalkylamines (a), the anionic surfactants (b) according to the invention also take part in the antioxidant properties of the additive compositions and textile auxiliaries according to the invention.

Compounds (b) of the invention are chosen from among alkyl sulphates, alkyl sulphonates, alkylaryl sulphonates, alkylether phosphates, alkyl carboxylates. Preferably the alkyl groups of these surfactants contain 8 to 22 carbon atoms, preferably 8 to 18 or further preferably 10 to 18 carbon atoms. They are preferably of paraffin type. Paraffin sulphates, sulphonates, and particularly lauryl, are preferred. They are preferably salts of alkali metals or alkaline-earth metals, in particular sodium or magnesium. The compositions of the invention preferably contain 10 to 50 weight % of one or more surfactants (b), or 15 to 40 weight %, or 20 to 40 weight %, most preferably 25 to 35 weight %.

Compounds (c)

The thioureas of formula $R_1R_2N(CS)NR_3R_4$ where $R_1$, $R_2$, $R_3$, $R_4$ are either hydrogen or hydrocarbon radicals, may play a part in the prevention of the oxidation phenomenon. For the compositions of the invention intended to be applied in aqueous solutions, preference is given to the thioureas in which $R_1$, $R_2$, $R_3$, $R_4$ are either hydrogen or hydrocarbon radicals containing 1 to 5 carbon atoms, preferably the thiourea of formula $H_2N(CS)NH_2$.

Their stabilization in aqueous solution, notably at low temperature, requires the presence of sequestering agents however such as EDTA (ethylenediamine tetraacetic acid), NTA (nitrilotriacetic acid), DTPA (diethylene triamine pentaacetic acid), phosphonic and gluconic acids, phosphonates, gluconates, polyacrylates. NTA, EDTA, DTPA are particularly preferred. These sequestering agents, when present, form an integral part of composition (c). In the compositions of the invention, compounds (c) represent 2 to 10%, preferably 3 to 7%, further preferably 4 to 5% by weight.

The respective proportions of sequestering agent and thioureas may vary, notably in relation to the type of thioureas in compositions (c). Preferably the content of sequestering agent is of the order of 0.2 to 2% in the additive compositions of the invention. In addition, for reasons of toxicity, heed of the environment or of regulations, these thioureas may be fully or partly substituted by compounds (d) as wetting and anti-freeze agents.

Compounds (d)

The wetting agents contained in these compositions (d) are dialkyl sulphosuccinates of formula:

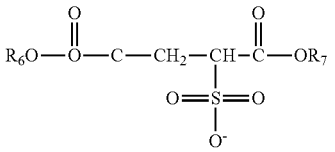

where $R_6$ and $R_7$ are alkyl groups containing 6 to 22 carbon atoms, preferably 6 to 12 carbon atoms.

They are preferably salts of alkali and alkaline-earth metals, preferably sodium salts. Preferably dihexyl, diheptyl, dioctyl, dinonyl sodium sulphosuccinates are used. The anti-freeze agents of compositions (d) are alcohols such as methanol or isopropanol, glycols such as glycerol, or glycol ethers designating ethylene glycol or propylene glycol ethers.

The glycol ethers of composition (d) meet the formula: $R—O—(CH_2—CH(X))_{n3}—O—R'$, X being either a hydrogen atom or a $CH_2$ group, R, R' being carbon chains containing 1 to 5 carbon atoms, and $n_3$ is in integer of between 1 and 10, preferably 1 and 5, and is preferably 1. Amongst the glycol ethers, monoethylene glycol ethers or monopropylene glycol ethers are preferred. In the compositions of the invention, compounds (d) represent 1 to 15%, preferably 2 to 12%, further preferably 3 to 5% by weight.

The respective proportions of dialkyl sulphosuccinate and anti-freeze may vary in the antioxidant compositions (d). Preferably, the weight percentages of these compounds in the additive compositions of the invention are identical.

Active Matter and Aqueous Solution or Emulsion:

The compositions of the invention, as active matter, contain compounds (a), (b), (c) and/or (d). They may also contain as additives any compound other than water which is suitable for use thereof e.g. anti-foaming agents.

These compositions are intended to be applied in the form of an aqueous solution or aqueous emulsion. It is preferred to formulate the compositions of the invention with water-soluble compounds.

The compositions of the invention are concentrates of active matter slightly diluted in water. They may for example contain less than 75 weight % water, preferably 10 to 70%, more preferably 50 to 60% water or 55 to 60% water by weight.

Textile Auxiliaries:

The textile auxiliaries of the invention are prepared by diluting in water the concentrated compositions of active matter described above. It is possible for example to dilute said compositions so that the total quantity of water represents more than 75% by weight of the textile auxiliary, preferably 95 to 99% by weight. Also, the textile auxiliaries of the invention comprise a total quantity by weight of active matter as represented by compounds (a), (b), (c) and/or (d) which ranges from 0.2% to 25%, preferably 1% to 5%. The above-described textile auxiliaries are used as dye levelling agents or to preserve the mechanical properties and dye affinity of textile fibres, yarns, fabrics or knits consisting of said fibres.

Use as Dye Levelling Agent:

Dye levelling agents are a category of textile auxiliary well known to a skilled person, the function of which is to ensure uniform distribution of the dye inside the fibre. Levelling defects translate for example as the presence, on one same article of dyed fabric or knit, of areas having different colour intensity, marks, bands. Uneven, approximate dyeing is of no commercial value and difficult to correct. Visual inspection of textiles treated with auxiliaries according to the invention has shown that they all have excellent level dyeing without the onset of any such areas.

Use to Preserve Mechanical Properties During Heat Treatment:

The mechanical properties with which we are concerned here are tenacity and ultimate elongation described in detail in the examples below, and for which it was observed that deterioration during heat treatment leads to dye defects. They are measured on yarns in accordance with standard UNI EN ISO 2026. The mechanical properties of textile yarns previously treated with the textile auxiliaries of the invention are not affected by heat treatments, notably conducted at temperatures of the order of 170 to 210° C., preferably of the order of 180 to 200° C.

Use to Preserve Dye Affinity During Heat Treatment:

Low dye affinity of textile fibres translates as yarns, fabrics or knits having a lighter shade than desired. The dye affinity of textile fibres, yarns, fabrics, knits consisting of textile fibres previously treated with textile auxiliaries of the invention is not affected by heat treatments, notably conducted at temperatures of the order of 170 to 210° C., preferably of the order of 180 to 200° C.

Textile Fibres:

Textile fibres may be of natural plant origin e.g. flax, cotton, jute, hemp, or of natural animal origin: Alpaca, Angora, Cashmere, wool, silk . . . . They may also be artificial. An artificial textile fibre is obtained by chemical treatment (dissolution followed by precipitation) of natural materials: milk caseins for lanital, cellulose of various plants (pine bark, bamboo, soy, birch) for viscose. This category includes cellulose acetate, cellulose triacetate, viscose . . . .

Finally, synthetic textile fibres can be found; a synthetic textile fibre is a crystalline polymer obtained after passing through a die. It is obtained by extrusion of polymer granulates obtained from hydrocarbons or starch. It is possible for example to obtain fibres from polylactic acid polymers, from acrylic polymers, polyamide fibres, aramid fibres (aromatic polyamide) chlorofibres obtained from PVC, polyurethane fibres, elastane fibres (lycra) obtained from polyurethane derivatives, polyester, polyethylene, polyphenol fibres, . . . .

The use of textile auxiliaries according to the invention concerns continuous textile fibres and yarns, more particularly synthetic textile fibres, notably those having degradation problems of their mechanical properties and of dye affinity under heat. One particularly preferred use concerns continuous textile fibres and yarns of polyamides or polyamide derivatives e.g. aramid derivatives.

The polyamide appellation (PA) groups together all polymers containing "amide" groups N—H—C═O. This amide group results from the reaction of an acid with an amine. Aliphatic polyamides are generally designated by figures relating to the number of carbon atoms contained in the repeat unit of the polymer.

For example PA6, PA11, PA12 designate the polyamides obtained by polymerization of an amino acid or lactam respectively having 6, 11 or 12 carbon atoms in the unit, or PA6.6, PA4.6, PA6.10, PA6.12 designate the polyamides obtained by polycondensation of a diacid and a diamine. In this second case, the first figure corresponds to the number of carbon atoms of the diamine, whereas the second corresponds to the number of carbon atoms of the diacid. On the other hand, the aromatic polyamides do not use any precise designation rule. Example: PAA (polyarylamide), PPA (polyphtalamide).

The polyamide textile fibres chiefly include nylon i.e. polyhexamethylene adipamide or fibre PA 6/6. The designation "aramid" denotes a category of synthetic fibres obtained from aromatic polyamides. The most known thereof is obtained from poly-para-phenylene diamine which can be found for example under the tradename Kevlar and Twaron. It is also possible to find other aramid textile fibres e.g. poly-meta-phenylenediamine.

Yarns:

Natural fibres which have lengths of the order 40 to 80 mm are made into yarn by spinning. Regarding synthetic fibres, the polymers are directly extruded through dies to form yarns. These yarns, on leaving the dies, can be used as such or cut into pieces similar to natural fibres and then combined to form rovings consisting of similar or different materials. These rovings are then drawn to form continuous yarns used to manufacture fabrics or knits. It is also possible to combine several continuous yarns together, these sometimes being of different type, to form the yarn which is finally used to manufacture cloth e.g. fabrics or knits.

Therefore yarns can often be found which are made of various materials among those listed above, notably various synthetic fibres including polyamide fibres in combination with elastane fibres to impart the advantage of elasticity. The weight proportion of elastane commonly varies between 0.1 and 40 weight % of yarns, fabrics or knits.

The use of textile auxiliaries according to the invention is particularly suitable for said textiles obtained from yarns containing elastane and which require heat treatment for dimensional setting. Typically, the uses of the invention are suitable for textiles containing up to 40% by weight of elastane, preferably up to 25%. Textiles broadly designate materials obtained from textile yarns: fabrics, knits, non-wovens.

Fabrics:

Fabrics are obtained by weaving which results from the interlacing, in one same plane, of yarns arranged in the warp direction and of yarns arranged perpendicular to these warp yarns in the direction of the weft.

Knits:

A knit (tricot or maille in French) is a stretch fabric with interlaced loops. It differs from other textiles usually consisting of interlaced weft and warp yarns since it comprises a single yarn that is wound together by looping often by means of a knitting needle. All textile fibres can be knitted. Hosiery is another term designating some knitted fabrics.

The uses of the textile auxiliaries according to the invention are particularly suitable for knits which, on account of their stretch nature, require heat treatments for dimensional setting, and more especially knits containing elastane. Priority is given to those uses of the textile auxiliaries according to the invention that are applied to knits combining polyamide and elastane, and in particular those containing 0.1 to 25% elastane.

Pre-Treatment Process of Yarns, Fabrics or Knits:

A further subject of the invention concerns treatment processes, more exactly the pre-treatment of yarns, fabrics or knits which uses the textile auxiliaries according to the invention and described in the foregoing. The purpose of the processes of the invention is to improve the level dyeing of knits or fabrics consisting of textile fibres, or further to preserve their mechanical properties or dye affinity during heat treatments.

Their chief characteristic is that they are applied upstream of the heat treatment operations (for example heat setting for dimensional stabilization) and dyeing operations. They comprise:

An immersion step in a bath called a pad-bath containing the textile auxiliaries of the invention, A pad mangling step to deposit on the surface of the yarns, fabrics or knits the required quantity of active matter (a)+(b)+(c) and/or (d).

Preferably this quantity of active matter lies between 0.1 and 5 weight %, preferably between 1 and 4%, further preferably between 2 and 4% by weight of active matter (a)+(b)(c) and/or (d) relative to the dry weight of the yarn, fabric or knit. It is also possible to characterize the mangling step by percentage expression which designates the weight percentage of textile auxiliary evacuated relative to the dry weight of yarn of cloth, or its counterpart the pick-up percentage which represents the weight percentage of retained textile auxiliary relative to the dry weight of the yarn or cloth.

These processes can be batch or continuous processes notably for industrial operations. For continuous processes the yarns, fabrics or knits typically travel through the pad-bath at velocities of the order of 1 to 20 metre per minute in tanks, or have a dwell time of the order of a few seconds to a few tens of seconds, typically less than 1 minute.

The mangling operation is conducted using two squeeze rolls spaced apart by a distance that is adjusted so as to deposit the desired quantity of active matter on the yarns, fabrics and knits. The fibres, fabrics or knits thus pre-treated are then subjected to heat treatment optionally followed by dyeing. The pre-treatment process of the invention does not perturb conventional treatment processes and does not require any specific modifications.

EXAMPLES

Example 1

Degradation of the Mechanical Properties of Polyamide Yarns after Heat-Set Treatment for Dimensional Stabilisation, Correlation with Loss of Dye Affinity Several batches of polyamide yarn knits (Nylon 6) consisting of 12 filaments were considered having a weight per unit length of yarn of 44 decitex (or 44 grams/1000 metres of yarn).

Each batch was subjected to heat treatment for dimensional stabilization at 185° C. and was then dyed with a same dye of metal type.

For each batch, part of the knit having a major dye defect (lighter) was isolated from the part of the knit dyed to the required shade (reg: regular). The two parts were then unravelled and the mechanical properties (tenacity and elongation) of the respective corresponding polyamide yarns were measured.

Tenacity and ultimate elongation are measured in accordance with standard UNI EN ISO 2026 using a Hounsfield H5KS dynamometer.

The tenacity of a yarn represents the force that needs to be applied to cause rupture. It is expressed in centiNewton/tex (1 tex=1 g/1000 m of yarn).

Elongation is measured simultaneously and represents relative elongation before rupture: (=If−Ii)/If, If being the maximum length before rupture, Ii the initial length. The results are grouped together in Table 1 below.

TABLE 1

Mechanical properties of heat-treated yarns and correlation with dye affinity

| | Batch 1 | | Batch 2 | | Batch 3 | | Batch 4 | | Batch 5 | |
|---|---|---|---|---|---|---|---|---|---|---|
| Dyeing | Reg | Light | Reg | Light | Reg | Light | Reg | Light | Reg | Light |
| dtex count g/10000m | 44.8 | 45.2 | 45.7 | 46 | 46.2 | 46.5 | 45.5 | 45.2 | 46.1 | 45.9 |
| Tenacity cN/tex | 27.9 | 26.8 | 26.5 | 23.4 | 26.1 | 22.6 | 28.9 | 25 | 29.3 | 24.7 |
| Elongation % | 29.8 | 26.8 | 31.4 | 28.4 | 27.6 | 24.1 | 30.9 | 24.5 | 35.2 | 26.4 |

The value in decitex of the yarn is evidently not affected by heat treatment; the minimal variations correspond to the repeatability of the method and to fluctuations in the production process.

It is ascertained on the other hand that yarn tenacity and elongation are systematically lower, within one same batch, for those yarn parts which gave a "lighter" colour under the same dyeing conditions.

Therefore the tenacities of the "regular" yarns are higher by 4%, 13%, 15%, 15.5%, 19% to those of the "lighter" yarns for the respective batches 1, 2, 3, 4 and 5.

Similarly, the elongations of "regular" yarns are higher by 11%, 10.5%, 14.5%, 26% and 33% respectively than those of "lighter" yarns in batches 1, 2, 3, 4 and 5.

The phenomenon of loss of dye affinity observed in some parts of the heat-treated batches is systematically observed in those parts having lesser tenacity and elongation properties.

Example 2

Influence of Pre-Treatment According to the Invention on Mechanical Properties and Dye Affinity No Pre-Treatment:

A batch of PA6-6 polyamide yarn knit was considered, 44 decitex, consisting of 48 filaments. This yarn was knitted with a 3-filament elastane yarn to form a knit containing 20% elastane (batch 6).

This batch had been returned by a customer for dye defects, the dye being an acid dye of dark purple colour for which it is particularly difficult to obtain sustained, uniform colour depth on polyamide knits subjected to heat treatment.

The customer return concerned part of batch 6 which had undergone the following operations:

Heat Treatment:

The knit is passed through a pad-bath solely containing water and is then mangled between two squeeze rolls.

It is then attached to pins to prevent the formation of creases and is passed through a heat-setting machine at 188° C. in which the dwell time is about 30 seconds.

Dyeing:

The knit is then dyed using JET equipment.

In that part of batch 6 which had been subjected to the above treatment, the heterogeneity of dyeing could be ascertained, the colouring being globally too pale compared with the shade which should have been obtained. The knit therefore showed three types of areas:

⇒ A very light area

⇒ A medium light area with bands

⇒ An area containing very pale parts and dark parts (bands)

On the unravelled polyamide yarn of each of these areas, the decitex value and elongation and tenacity were measured in accordance with UNI EN ISO 2062. The values are grouped together in Table 2 below.

TABLE 2

Batch 6, no pre-treatment before heat setting

| | decitex | Elongation % | Tenacity cN/tex |
|---|---|---|---|
| Dark bands | 45.6 std. deviation: 0.1 | 25.3 std. deviation: 1.1 | 32.7 std. deviation: 2.6 |
| Medium light bands | 45.3 std. deviation: 0.2 | 23.6 std. deviation: 1.4 | 31.0 std. deviation: 2.9 |

TABLE 2-continued

| Batch 6, no pre-treatment before heat setting | | | |
|---|---|---|---|
| | decitex | Elongation % | Tenacity cN/tex |
| Very light | 45.0 std. deviation: 0.4 | 22.7 std. deviation: 1.6 | 30.0 std. deviation: 3.2 |

Upstream Pre-Treatment:

Further to the customer return, an additional test was conducted with the remaining part of the same knit of batch 6 which had not yet undergone any heat treatment or dyeing.

This remaining part of the knit was pre-treated and dyed under the same conditions as those described above. However, in this test a 10 weight % aqueous composition C1 of the invention was added to the water of the pad-bath, this composition containing:

(a) 8 weight % triethanolamine (b) 30 weight % paraffin sulphonate (c) 8 weight % thiourea and 1% EDTA QS water The spacing of the squeeze rollers placed after the pad-bath was adjusted so that the pick-up percentage of knit was in the order of 60% which represents a deposit of active matter (excluding water) of the order of 3.5 g/100 g dry knit.

The sample thus treated was of industrial size. It represented about 500 kg of treated yarn. The entirety of the sample showed a uniform appearance and colour having the required intensity after dyeing (regular).

The elongation and tenacity of the corresponding unravelled polyamide yarn were measured as per UNI EN ISO 2062. The values are grouped together in Table 3 below.

TABLE 3

| Batch 6 with pre-treatment according to the invention | | | |
|---|---|---|---|
| | decitex | Elongation % | Tenacity cN/tex |
| Regular (with pre-treatment) | 45.4 stand. Deviation: 0.3 | 26.8 stand. Deviation: 2.3 | 33.5 stand. Deviation: 1.6 |

It is observed that the mechanical properties of the yarn which underwent pre-treatment according to the invention are systematically greater than those measured on non-pretreated yarns given in Table 2, and in particular are significantly greater than those of the light and very light samples (respectively 13 and 18% greater for elongation, and 8 and 11% greater for tenacity).

The effect of pre-treatment is confirmed visually by improved uniformity of dyeing and better colour depth.

Therefore pre-treatment with the compositions of the invention allows the dye affinity of fibres to be preserved and also improves level dyeing.

Downstream Treatment with a Composition of the Invention:

Under the same conditions, a knit of polyamide yarn PA 6-6, 44 decitex consisting of 48 filaments in every way identical to the one in batch 6 was pre-treated and dyed.

This latter knit (batch 7) was fabricated using a polyamide yarn derived from the same spool as for batch 6, but contrary to the yarn from batch 6 it previously underwent heat treatment at the time of forming (texturing).

The result after dyeing is a knit whose shade is much too light (very light) despite treatment with the composition of the invention applied before heat setting for dimensional stabilization but after heating at the time of texturing.

The corresponding polyamide yarn was unravelled and its tenacity and ultimate elongation were measured as per UNI EN ISO 2062. The results are grouped in Table 5.

TABLE 5

| Batch 7 | | | |
|---|---|---|---|
| | decitex | Elongation % | Tenacity cN/tex |
| | decitex | Elongation % | Tenacity cN/tex |
| Very light (with treatment on yarn heated on texturing) | 45.4 stand. Deviation: 0.3 | 26.8 stand. deviation: 2.3 | 33.5 stand. deviation: 1.6 |

It is ascertained that the mechanical properties are poor, being comparable with those of the "very light" sample in batch 6. The rise in temperature during the prior texturing step had most probably already oxidized the fibres causing degradation of mechanical properties and of dye affinity.

The compositions of the invention do not therefore allow restoration of the mechanical properties and dye affinity of polyamide fibres already heat-treated. Treatment with these compositions must be applied in the form of a pre-treatment upstream of the heat treatment.

Example 3

Type of Pre-Treatment Solutions

The pre-treatment in Example 2 was reproduced with a composition C2 according to the invention containing:

(a) 12 weight % triethanolamine (b) 25 weight % paraffin sulphonate (c) 8 weight % sulphosuccinate and 6% propylene glycol ether QS water An improvement was similarly observed in the mechanical properties of the yarn which had undergone pre-treatment with the composition of the invention.

The invention claimed is:

1. A textile auxiliary composition consisting of:

a. one or more hydroxyalkylamines of formula: $NX_1X_2(C_nH_{2n}OH)$ where $X_1$ and $X_2$ each independently are either hydrogen or hydroxyalkyl radicals of respective formulas $C_{n1}H_{2n1}OH$ and $C_{n2}H_{2n2}OH$, and n, $n_1$, $n_2$, are integers ranging from 2 to 6 and b. one or more anionic surfactants chosen from among alkyl sulphates, alkyl sulphonates, alkylaryl sulphonates, alkylether phosphates, alkyl carboxylates, and at least one compound (c) and/or (d) such that:

c. is chosen from among one or more thioureas (thiocarbamides) of formula $R_1R_2N(CS)NR_3R_4$ where $R_1$, $R_2$, $R_3$, $R_4$ each independently are either hydrogen or hydrocarbon radicals having 1 to 5 carbon atoms, one or more sequestering agents, and mixtures thereof, d. is chosen from among one or more dialkyl sulphosuccinates or the salts of alkali and alkaline earth metals thereof in combination with one or more anti-freeze agents chosen from among methanol, isopropanol, glycols, or glycol ethers and wherein (a) represents 1 to 15 weight %, (b) represents 20 to 40 weight %, at least one of: (c) and (d) represent 3 to 15 weight % of the composition, and wherein the composition is diluted in water and the total quantity by weight of active matter represented by compounds (a), (b), (c) and/or (d) ranges from 0.2% to 25%.

2. The textile auxiliary according to claim 1, wherein the total quantity of water represents more than 75 weight %.

3. The textile auxiliary according to claim 1, wherein the sequestering agents are chosen from EDTA (ethylene diamine tetraacetic acid), NTA (nitrilotriacetic acid), DTPA (diethylene triamine pentaacetic acid), phosphonic acids, gluconic acids, phosphonates, gluconates and polyacrylates.

4. The textile auxiliary according to claim 3, wherein the sequestering agent(s) represent 0.2 to 2 weight % in the composition.

5. The textile auxiliary according to claim 1, wherein at least one hydroxyalkylamine (a) is such that $X_1$ and $X_2$ represent hydrogen and n is an integer ranging from 2 to 6.

6. The textile auxiliary according to claim 5, wherein at least one hydroxyalkylamine (a) is chosen from monoethanolamine, diethanolamine and triethanolamine.

7. The textile auxiliary according to claim 1, wherein the alkyl groups of the anionic surfactants (b) contain 8 to 22 carbon atoms.

8. The textile auxiliary according to claim 1, wherein among the thioureas (c) at least one radical $R_1$,$R_2$,$R_3$ or $R_4$ represents hydrogen.

9. The textile auxiliary according to claim 1, wherein the alkyl dialkylsulphosuccinate groups of compounds (d) contain 8 to 22 carbon atoms.

10. The textile auxiliary according to claim 1, wherein compounds (d) are the salts of alkali and alkaline-earth metals of dialkyl sulphosuccinates.

11. The textile auxiliary according to claim 1, wherein the glycol ethers of composition (d) meet the formula $R—O—(CH_2—CH(X))_{n3}—O—R'$ with X being either a hydrogen atom or a $CH_2$ group, R, R' being carbon chains comprising between 1 and 5 carbon atoms, and $n_3$ is an integer of between 1 and 10.

12. The textile auxiliary according to claim 1, consisting of (a), (b) and (c) wherein (c) is a mixture of a thiourea and a sequestering agent.

13. The textile auxiliary according to claim 1, consisting of (a), (b) and (d).

14. A method to treat textile fibres, textile yarns, fabrics or knits which comprises the following steps: pre-treatment by immersion of the textile fibres, textile yarns, fabrics or knits in a textile auxiliary comprising:

(a) one or more hydroxyalkylamines of formula: $NX_1X_2(C_nH_{2n}OH)$ where $X_1$ and $X_2$ each independently are either hydrogen or hydroxyalkyl radicals of respective formulas $C_{n1}H_{2n1}OH$ and $C_{n2}H_{2n2}OH$, and n, $n_1$, $n_2$ are integers ranging from 2 to 6, and (b) one or more anionic surfactants chosen from among alkyl sulphates, alkyl sulphonates such as paraffin sulphonates, alkylaryl sulphonates, alkylether phosphates, alkyl carboxylates, and at least one compound (c) and/or (d) such that:

(c) is chosen from among one or more thioureas (thiocarbamides) of formula $R_1R_2N(CS)NR_3R_4$ where $R_1$, $R_2$, $R_3$, $R_4$ each independently are either hydrogen or hydrocarbon radicals having 1 to 5 carbon atoms, (d) is chosen from among one or more dialkyl sulphosuccinates in combination with one or more anti-freeze agents chosen from among methanol, isopropanol, glycols, or glycol ethers, wherein said textile fibres, textile yarns, fabrics or knits, after the pre-treatment step, are then pad mangled so that they are coated with 0.1 to 5 weight % of active matter (a)+(b)+(c) and/or (d) relative to the dry weight of the textiles fibres, yarn, fabric or knit, followed by heat treatment to ensure the dimensional stabilization of the textiles fibres, yarns, fabrics or knits.

15. The method according to claim 14, wherein the textile fibres are synthetic fibres.

16. The method according to claim 14, wherein the textile yarns, fabrics or knits contain elastane fibres in combination with other textile fibres.

17. The method according to claim 14, wherein the heat treatment is conducted at a temperature between 170° C. and 210° C.

18. The method according to claim 14, further comprising a dyeing step.

* * * * *